United States Patent [19]

Staempfli

[11] Patent Number: 4,587,733

[45] Date of Patent: May 13, 1986

[54] PERCUSSION DEVICE

[75] Inventor: Jackie Staempfli, Geneva, Switzerland

[73] Assignee: Tulcea, S.A., Vaduz, Liechtenstein

[21] Appl. No.: 654,001

[22] PCT Filed: Jan. 9, 1984

[86] PCT No.: PCT/CH84/00002

§ 371 Date: Sep. 11, 1984

§ 102(e) Date: Sep. 11, 1984

[87] PCT Pub. No.: WO84/02769

PCT Pub. Date: Jul. 19, 1984

[30] Foreign Application Priority Data

Jan. 11, 1983 [FR] France ..... 83 00359

[51] Int. Cl.[4] ..... B26B 3/00

[52] U.S. Cl. ..... 30/278; 30/92; 30/277; 83/639; 114/221 A

[58] Field of Search ..... 83/370, 639; 114/221 A; 89/1.14; 102/275.6, 275.11, 499, 500; 30/241, 278, 277, 92

[56] References Cited

U.S. PATENT DOCUMENTS

| | | | |
|---|---|---|---|
| 1,450,672 | 4/1923 | McEwan | 102/72 |
| 2,140,214 | 12/1938 | Temple, Jr. | 164/56 |
| 3,353,445 | 11/1967 | Temple et al. | 89/1 |
| 3,369,534 | 2/1968 | Crosman | 124/26 |
| 3,386,334 | 6/1968 | Temple et al. | 89/1.14 |
| 4,026,028 | 5/1977 | Green | 30/233 |

FOREIGN PATENT DOCUMENTS

| | | |
|---|---|---|
| 576784 | 8/1924 | France . |
| 822399 | 12/1937 | France . |
| 866767 | 9/1941 | France . |
| 2004537 | 11/1969 | France . |
| 2423747 | 11/1979 | France . |

*Primary Examiner*—E. R. Kazenske
*Assistant Examiner*—Hien H. Phan
*Attorney, Agent, or Firm*—Cushman, Darby & Cushman

[57] ABSTRACT

Percussion device for triggering the primer of a blasting charge of an actuation device. It comprises a striker (4) moveably housed and retained in a support (1), as well as a helical traction spring (7) of which one end (8) is secured to the striker. The other end (9) of the spring (7) is provided with a hook member (10) allowing to maintain the spring in a tensioned state and to suddenly release the spring to cause the percussion by spring contraction. The invention is particularly applicable to devices to sever cables, for example on boats, in case of dismasting.

5 Claims, 4 Drawing Figures

PERCUSSION DEVICE

The present invention refers to a percussion device for triggering the primer of an explosive charge in an actuator device, including a support arranged in order to be able to be attached to the said actuator device, a striker member which is equipped with a percussion tip and is mounted to be able to move with respect to the support so as to be able to trigger the primer under the effect of a force acting upon this striker member and a spiral spring for delivering the said force to the striker member.

Devices of this type generally include a compression spring which acts upon one end of a striker member so as to accelerate it over a distance which corresponds with the elongation of the spring upon its expansion. These devices are rather complicated, costly and relatively heavy.

The aim of the invention is to provide a percussion device which is extremely simple, effective and light and very low in cost price.

With this object, the device in accordance with the invention is characterized in that the spiral spring is a tension spring the first end of which is attached to the striker member which is equipped with a percussion tip and is mounted to be able to move with respect to the support so as to be able to trigger the primer under the effect of a force acting upon this striker member and a spiral spring for delivering the said force to the striker member, characterized in that the spiral spring (7) is a tension spring the first end of which is attached to the striker member (4), the percussion device including means (10) of holding back the second end of the spring so as to keep it in a stretched state corresponding with the cocked state of the percussion device, and of freeing this second end of the spring at the required moment so as to cause contraction of the spring and the appearance at the first end of it.

The support of this percussion device may exhibit a tubular shape, a first end of the support being arranged so as to enable mounting of the actuator device and the wall of the support being arranged so as to hold a striker member of essentially cylindrical shape in the vicinity of the primer, the second end of the spring being preferably equipped with a hook member arranged so as to cooperate with the second end of the support.

The invention may be employed in particular for the creation of a tool for cutting wires or cables, the percussion device being then associated with an actuator device in the form of a holder unit for a cutter driven by an explosive charge, mounted on the support of the percussion device.

The percussion device in accordance with the invention includes a minimum of different parts and may be produced, at least as far as the support and the striker member are concerned, from very light materials such as alloys of aluminium or plastics matter. It may in particular be designed in order to be associated with an actuator device intended to serve only once, such, for example, as a holder unit for a cutter driven by an explosive charge for the cutting of guy cables, which may be employed in particular on a boat in the event of dismasting, or of high voltage electric cables.

The invention will be better understood in the light of the description given below of embodiments illustrated in the attached drawing.

DESCRIPTION OF THE PREFERRED EMBODIMENT

Figure 1:
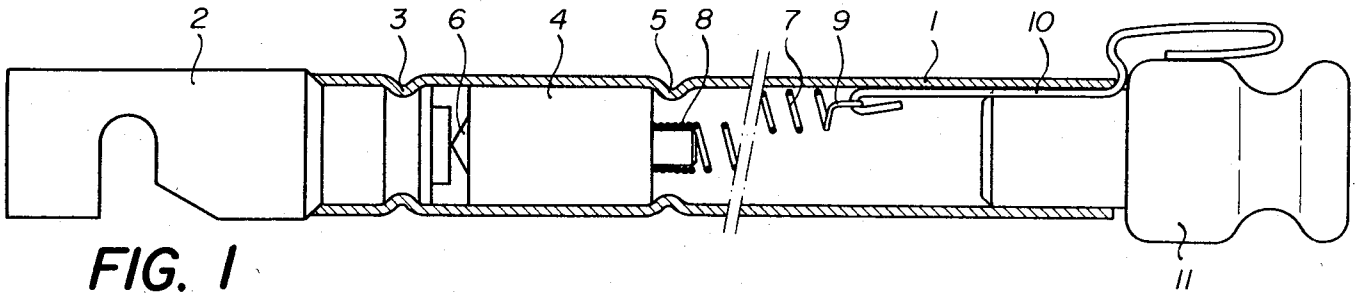
FIG. 1 is an axial section of an embodiment of a percussion device in accordance with the invention, associated by way of example with a cutter-holder unit for cutting a cable, this FIG. 1 representing the cocked state of the percussion device.
Figure 2:
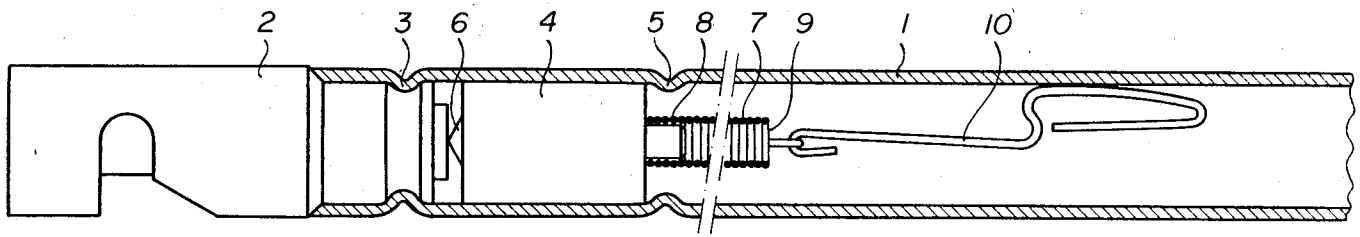
FIG. 2 is a similar view of the assembly as FIG. 1 in the state following the percussion.

The percussion device represented in FIGS. 1 and 2 includes a tubular support 1 to a first end of which is attached a cutter-holder unit 2 indicated diagrammatically in these two Figures. The attachment is effected in this example by simple deformation of the wall of the support, that is to say, by crimping as shown at the point 3 on the support.

A striker member 4 of essentially cylindrical shape is housed inside the tubular support so as to be movable in the axial direction. This movement is limited in the direction of the second end of the support by a deformation 5 of the wall of the support, whereas a percussion tip 6 is arranged close to the end of the cutter-holder unit, which encloses the primer. The member 4 is produced from a light material and thus presents a low inertia. A spiral tension spring 7 is attached by a first end 8 to the striker member 4, for example, by screwing onto a threaded lug on this member. The second end 9 of this spring is equipped in the present embodiment with a hook member 10 arranged so as to enable the spring 7 to be kept in a stretched state by hooking the member 10 onto the edge of the second end of the support 1. This hook member 10 is in addition arranged so as to enable the corresponding end of the spring 7 to be freed abruptly so that it can contract practically freely with respect to its first end which is integral with the striker member 4.

It should be observed that in FIGS. 1 and 2 the support 1 and the spring 7 are not drawn at full length but are broken for reasons of space. In the contracted and hence released state the spring may have, for example, a length two to five times the length of the striker member as shown, but this length of the spring is of course purely a question of dimensioning, depending essentially on the percussive force that it is desired to obtain.

That is, when the stretched spring is suddenly freed at the level of its second end, the consecutive coils approach one another practically simultaneously and together they approach the end of the spring attached to the striker member which is held in the support. The speed of contraction of the consecutive coils depends on the elastic force of the spring and the velocity of the nth coil with respect to the fixed end of the spring is obviously increased by the sum of the velocities of the preceding coils, that is to say, those situated between the fixed end and this nth coil. Thus a considerable kinetic energy appears at the level of the striker member at the end of the phase of contraction of the spring, and this low-inertia member is projected in the direction of the primer.

It is found that the required percussive force may be obtained by means of tension springs which are in quite general use, although these springs are not at all designed for being employed in the present manner according to which one end is freed.

FIG. 1 shows in addition a very simple safety member in the form of a stopper 11 which in the stored state is placed in the end of the support in order to prevent the hook member from being freed unintentionally.

Figure 3:
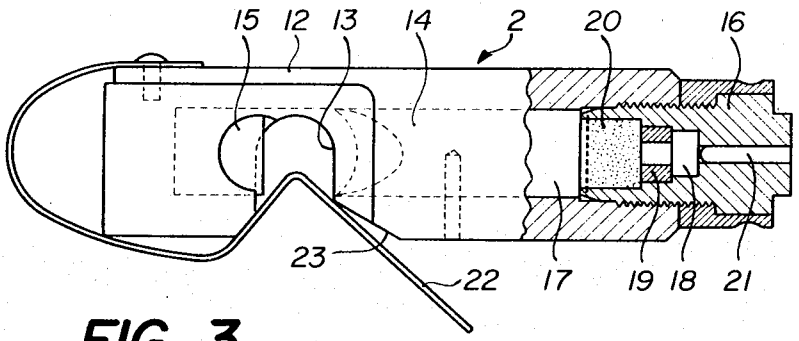
FIG. 3 is a view partially in section, of a cutterholder unit employed in the assembly as in FIGS. 1 and 2.

FIG. 3 represents in greater detail a cutter-holder unit 2 such as may be employed in the assembly as in FIGS. 1 and 2. This cutter-holder unit includes a longitudinal body portion 12 which exhibits a transverse slot 13 intended for the insertion of a cable, wire or the like for cutting. A movable cutter 14 is housed in the body portion 12 so as to be movable with respect to a fixed cutter 15, the cutting edges of the fixed and movable cutters being located in the rest position on opposite sides of the slot 13.

A primer and propellant device is contained in a bush 16 screwed into the end of the body portion 12 near to the end 17 of the movable cutter remote from the cutting edge. The bush 16 contains a primer 18, a separator ring 19 and a propellant charge 20 arranged in the vicinity of the end 17 of the movable cutter. A primer pin 21 presents one end of it at the outer surface of the bush 16. The striker member upon release of the spring 7 comes and strikes this primer pin 21 and the firing of the propellant charge 20 projects the movable cutter 14 in the direction of the fixed cutter 15, so causing cutting of the wire or cable placed in the slot 13.

FIG. 3 shows in addition a leaf spring 22 mounted on the body portion 12 and intended for guiding and holding the cable for cutting in the slot 13. The latter exhibits a guide face 23 in order to facilitate putting the cutter-holder unit in position on the cable for cutting.

The shape and the mounting of the spring 22 likewise ensure damping at the time of a shock on the unit 2, for example, when the tool falls, so as to avoid a corresponding acceleration of the mass 4 that might produce a percussion.

Figure 4:
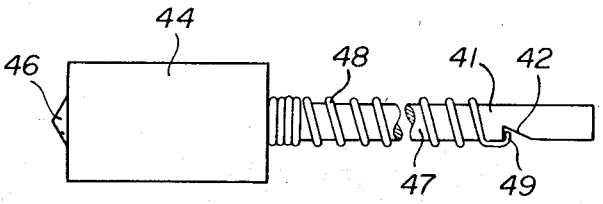
FIG. 4 is a view of a striker member in accordance with a variant embodiment of the present device.

FIG. 4 illustrates a variant embodiment of the percussion device as in FIG. 1. It shows a striker member 44 similar to the member 4 in FIG. 1, but the portion of it remote from the percussion tip 46 exhibits an extension in the form of a rod 41 arranged in parallel with the axis of the spiral spring 47, more particularly coaxially inside this spring. One end 48 of the spring is attached to the rod 41 in the vicinity of the body 44. The rod 41 includes a notch 42 enabling the second end 49 of the spring 47 to be hooked so as to hold it and keep the spring in the stretched state corresponding with the cocked state of the percussion device. Suitable means (not shown) may be provided for the release of this second end of the spring at the required moment, so as to enable contraction of the latter in a similar way to the example of FIGS. 1 and 2. It should be observed that in the case of FIG. 4 the cocking of the spring does not necessitate a support such as the support 1 in FIG. 1. The rod 4 may in addition serve as a guide member for the spring 47 at the time of its contraction. Of course the portion 41 may have other shapes than in FIG. 4, for example, it may be tubular and surround the spring.

Of course the examples illustrated form only two of numerous possible embodiments of the invention and are essentially intended to illustrate the simplicity that may be achieved in the practical design of the percussion device in accordance with the invention. It is equally clear to one skilled in the art that the percussion device may easily be recocked and reused if that is desired in a given application. The actuator device will in that case likewise be reused or replaced. The type of actuator device employed is obviously a function of the application envisaged. One skilled in the art knows numerous devices in which a member is actuated or propelled under the effect of an explosive charge triggered by percussion.

I claim:

1. A percussion device for triggering the primer of an explosive charge in an actuator device, including a support arranged in order to be able to be attached to the said actuator device, a striker member which is equipped with a percussion tip and is mounted to be able to move with respect to the support so as to be able to trigger the primer under the effect of a force acting upon this striker member and a spiral spring for delivering the said force to the striker member, characterized in that the spiral spring (7) is a tension spring a first end of which is attached to the striker member (4), the percussion device including means (10) for holding back a second end of the spring so as to keep it in a stretched state corresponding with a cocked state of the percussion device, and for freeing this second end of the spring at the required moment.

2. A percussion device as in claim 1, characterized in that the support (1) is arranged so as to hold the striker member (4) in the vicinity of the priming position and the means for holding (10) are arranged so as to hold the said second end of the spring, with the percussion device in the cocked state, in a fixed position with respect to the support.

3. A percussion device as in claim 2, characterized in that the support has a tubular shape, a first end of the support being arranged so as to enable mounting of the actuator device (2) and the support being arranged so as to hold a striker member of essentially cylindrical shape in the vicinity of the primer, and in that the second end of the spring is equipped with a hook member arranged so as to cooperate with a second end of the support.

4. A percussion device as in claim 1, characterized in that the striker member has at the end of it remote from the percussion tip, a longitudinal extension parallel with the axis of the spiral spring, the means of holding the second end of the spring being arranged so as to hold this end, with the percussion device in the cocked state, in a fixed position with respect to this extension.

5. A tool for cutting wires or cables, which includes a percussion device for triggering the primer of an explosive charge in an actuator device, including a support arranged in order to be able to be attached to the said actuator device, a striker member which is equipped with a percussion tip and is mounted to be able to move with respect to the support so as to be able to trigger the primer under the effect of a force acting upon this striker member and a spiral spring for delivering the said force to the striker member, characterized in that the spiral spring is a tension spring, a first end of which is attached to the striker member, the percussion device including means for holding back the second end of the spring so as to keep it in a stretched state corresponding with the cocked state of the percussion device, and for freeing this second end of the spring at the required moment, said tool further including an actuator device in the form of a holder unit for a cutter driven by an explosive charge, mounted on the support of the percussion device.

* * * * *